US010125405B2

(12) United States Patent
Lainati et al.

(10) Patent No.: US 10,125,405 B2
(45) Date of Patent: Nov. 13, 2018

(54) METHOD AND SYSTEM FOR THERMAL TREATMENTS OF RAILS

(71) Applicant: PRIMETALS TECHNOLOGIES ITALY S.R.L., Marnate Va (IT)

(72) Inventors: Alberto Gioachino Lainati, Saronno (IT); Luigi Langellotto, Pomezia (IT); Andrea Mazzarano, Gerenzano di Roma (IT); Federico Pegorin, Cassano Magnago (IT); Alessio Saccocci, Rome (IT); Augusto Sciuccati, Legnano (IT)

(73) Assignee: PRIMETALS TECHNOLOGIES ITALY S.R.L., Marnate VA (IT)

( * ) Notice: Subject to any disclaimer, the term of this patent is extended or adjusted under 35 U.S.C. 154(b) by 352 days.

(21) Appl. No.: 14/407,141

(22) PCT Filed: Jun. 7, 2013

(86) PCT No.: PCT/EP2013/061793
§ 371 (c)(1),
(2) Date: Dec. 11, 2014

(87) PCT Pub. No.: WO2013/186137
PCT Pub. Date: Dec. 19, 2013

(65) Prior Publication Data

US 2015/0107727 A1 Apr. 23, 2015

(30) Foreign Application Priority Data

Jun. 11, 2012 (EP) ..... 12425110

(51) Int. Cl.
*C21D 11/00* (2006.01)
*C21D 1/18* (2006.01)
(Continued)

(52) U.S. Cl.
CPC ..... *C21D 11/005* (2013.01); *C21D 1/18* (2013.01); *C21D 1/20* (2013.01); *C21D 1/667* (2013.01);
(Continued)

(58) Field of Classification Search
CPC ..... C21D 11/00; C21D 11/005; C21D 1/18; C21D 1/20; C21D 1/667; C21D 2211/002;
(Continued)

(56) References Cited

U.S. PATENT DOCUMENTS 4,611,789 A 9/1986 Ackert et al.
4,668,308 A 5/1987 Economopoulos et al.
(Continued)

FOREIGN PATENT DOCUMENTS

CN 85109735 A 7/1986
CN 1140473 A 1/1997
(Continued)

*Primary Examiner* — Jenny R Wu
(74) *Attorney, Agent, or Firm* — Laurence A. Greenberg; Werner H. Stemer; Ralph E. Locher

(57) ABSTRACT

A method thermally treats hot rails to obtain a desired microstructure having enhanced mechanical properties. The method includes an active cooling phase where the rail is fast cooled from an austenite temperature and subsequently soft cooled, to maintain a target transformation temperature between defined values. The cooling treatment is performed by a plurality of cooling modules. Each of the cooling modules has a plurality of devices spraying a cooling medium onto the rail. The method is characterized in that during the active cooling phase, each cooling device is driven to control the cooling rate of the rail such that the amount of transformed austenite within the rail is not lower than 50% on the rail surface and not lower than 20% at a rail head core.

8 Claims, 7 Drawing Sheets

(51) Int. Cl.
*C21D 9/04* (2006.01)
*C21D 1/20* (2006.01)
*C21D 1/667* (2006.01)

(52) U.S. Cl.
CPC ..... *C21D 9/04* (2013.01); *C21D 11/00* (2013.01); *C21D 2211/002* (2013.01); *C21D 2211/009* (2013.01); *C21D 2221/00* (2013.01); *C21D 2221/10* (2013.01)

(58) Field of Classification Search
CPC ..... C21D 2211/009; C21D 2221/00; C21D 2221/10; C21D 9/04
See application file for complete search history.

(56) References Cited

U.S. PATENT DOCUMENTS

| | | | | |
|---|---|---|---|---|
| 4,913,747 | A | 4/1990 | Fukuda et al. | |
| 5,645,653 | A | 7/1997 | Jerath et al. | |
| 5,762,723 | A | 6/1998 | Ueda et al. | |
| 6,689,230 | B1 | 2/2004 | Meyer et al. | |
| 7,217,329 | B2 * | 5/2007 | Cordova | C21D 9/04 148/333 |
| 2002/0020474 | A1 | 2/2002 | Meyer et al. | |
| 2004/0187974 | A1 | 9/2004 | Kuppers et al. | |
| 2006/0117549 | A1 | 6/2006 | Plocoennik et al. | |

FOREIGN PATENT DOCUMENTS

| | | | |
|---|---|---|---|
| EP | 0098492 | A2 | 1/1984 |
| IT | LI20090004 | A1 | 11/2010 |
| JP | S58133317 | A | 8/1983 |
| JP | S5974227 | A | 4/1984 |
| JP | S61149436 | A | 7/1986 |
| JP | H09227942 | A | 9/1997 |
| JP | H09316598 | A | 12/1997 |
| JP | H11152520 | A | 6/1999 |
| JP | H11152521 | A | 6/1999 |
| JP | 2002105538 | A | 4/2002 |
| JP | 2011504968 | A | 2/2011 |
| RU | 2266966 | C2 | 12/2005 |
| RU | 2336339 | C2 | 10/2008 |

* cited by examiner

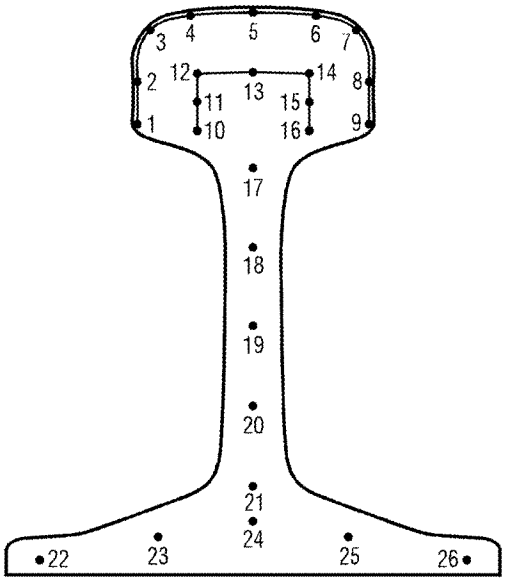
FIG 11
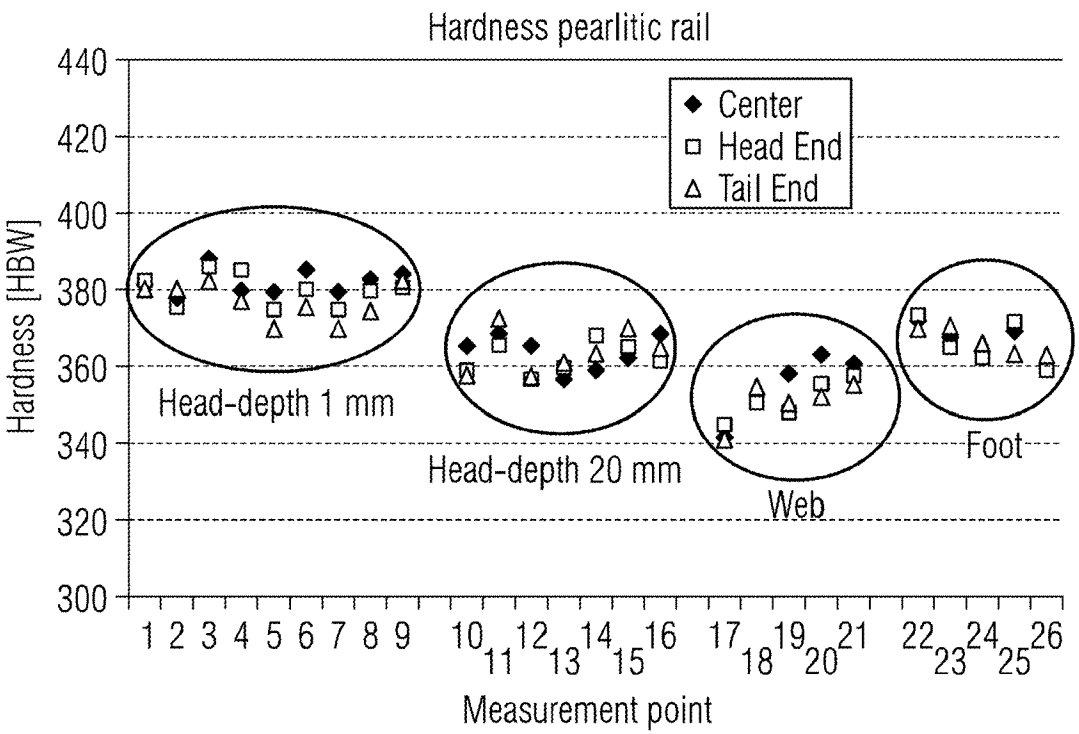

METHOD AND SYSTEM FOR THERMAL TREATMENTS OF RAILS

BACKGROUND OF THE INVENTION

Field of the Invention

The invention relates to a thermal controlled treatment of rails and to a flexible cooling system to carry out the method. The treatment is designed for obtaining fully high performance bainite microstructure characterised by high strength, high hardness and good toughness in the whole rail section and, also, for obtaining fully pearlite fine microstructure in a selected portion of the rail section or in the whole rail section.

Nowadays, the rapid rise in weight and speed of trains, has inevitably forced to enhance the rails wear rate, in terms of loss of material due to the rolling/sliding between wheel and rail, and therefore an increasing of hardness has been required in order to reduce wear.

Generally, the final characteristics of a steel rail in terms of geometrical profiles and mechanical properties are obtained through a sequence of a thermo-mechanical process: a hot rail rolling process followed by a thermal treatment and a straightening step.

The hot rolling process profiles the final product according to the designed geometrical shape and provides the pre-required metallurgical microstructure for the following treatment. In particular, this step allows the achievement of the fine microstructure which, through the following treatments, will guarantee the high level of requested mechanical properties.

At present, two main hot rolling processes, performed in two kinds of plant, reversible and continuous mills, are available. The final properties of a rail produced by both of these hot rolling processes can be assumed as quite similar and comparable. In fact, bainitic, pearlitic and hypereutectoidic rails are commonly obtained at industrial level through these both kinds of plant.

The situation for thermal treatments is different. At present, there are mainly two means used to cool the rails: air or water. The water is typically used as liquid in a tank or sprayed with nozzles. Air is typically compressed through nozzles. None of these arrangements allows producing all the rail microstructures with the same plant. In particular, a thermal treatment plant tuned for production of pearlitic rails cannot produce bainitic rails.

Further, present cooling solutions are not flexible enough and therefore, it is not possible to treat the whole rail section or portions of the rail section in differentiated ways (head, web, foot).

Furthermore, in all the present industrial apparatus for thermal treatment of rails, most of the transformation of austenite occurs outside the cooling apparatus itself, this means that the treatment is not controlled. In particular, the increase of rail temperature due to the microstructure transformation cannot be controlled. In these processes the temperature at which austenite transformation occurs is different than the optimal one, with final mechanical characteristics lower than those potentially obtainable by finer and more homogeneous microstructures. This could be particularly true in case of bainite rails, where bainite microstructure has to be obtained in the whole rail section (head, web and foot).

Moreover, due to the real thermal profile of the rail along the length, a non controlled thermal treatment, can conduct to microstructures inhomogeneity also along the length.

U.S. Pat. No. 7,854,883 discloses a system for cooling a rail wherein only fine pearlite microstructure can be obtained. According to this document, a fine pearlite microstructure is created into the rail to increase the rail hardness. However, fine pearlite microstructure means high level of hardness but with degradation of elongation and toughness of the product. Elongation and toughness are also important mechanical properties for rails applications; in fact, both are related to the ductility of the material, an essential property for rail materials for the resistance to crack growth phenomena and failures.

Recent studies pointed out also to another particular and dangerous phenomenon, prevalent in pearlitic materials due to the particular chemical composition that affects the integrity of the rail during service. The discover concerned the formation of a martensitic layer, called White Etching Layer (WEL), in the contact sliding area between wheel and rail, especially due to the generation of high temperatures during severe accelerations and decelerations or surface mechanical attrition treatment. Due to its hard and brittle property WEL is usually believed to be the location of crack formation, with a consequent negative effect on the rail lifetime. The WEL formed in the bainitic steel rails has low hardness; therefore, a smaller difference in hardness compared to the base material is present. The reason is that the hardness of the martensitic layer mainly depends on the C content (higher the carbon and higher the hardness of the layer) and the quantity of carbon in bainitic chemical composition is lower than those present in pearlitic microstructure. From some researcher, WEL is considered as one of the cause of rolling contact fatigue. From studies on these topics appear that the bainitic steel rail showed at least twice the time for crack nucleation than that of the pearlitic steel rail.

High performance bainite microstructure is an improvement in respect to fine pearlite microstructure in terms of both wear resistance and rolling contact fatigue resistance. Further, high performance bainite microstructure allows enhancing toughness and elongation, keeping hardness greater than fine pearlite microstructure.

High performance bainite microstructure shows a better behaviour at following phenomena in comparison with fine pearlite microstructure: short and long pitch corrugation, shelling, lateral plastic flow and head checks. These typical rail defects are amplified by train acceleration and deceleration (e.g. Underground lines) or in low radius curves.

Furthermore, bainitic steel shows also higher values of ratio between yield strength and ultimate tensile strength, tensile strength and fracture toughness compared to the best heat-treated pearlitic steel rails.

Therefore there is a need to have a new thermal treatment method and system allowing obtaining rail with good hardness but without any degradation of the other important mechanical properties as for example elongation and toughness. In this way, the resistance of the rail to the wear and to rolling contact fatigue would be improved and crack propagation would be decreased.

BRIEF SUMMARY OF THE INVENTION

The main objective of the invention is therefore to provide this kind of process and apparatus.

A companion objective of the present invention is to provide a thermal treatment process which allows the formation high performance bainite microstructure in the rail.

Another objective of the present invention is to provide a process and system allowing in the same plant production of rail having fine pearlite microstructure.

This objective is obtained, according to a first aspect of the invention thanks to a method of thermal treatment of hot rails to obtain a desired microstructure, having enhanced mechanical properties the method comprising an active cooling phase wherein, the rail is fast cooled from an austenite temperature, and subsequently soft cooled, to maintain a target transformation temperature between defined values the cooling treatment being performed by a plurality of cooling modules (12.*n*), each cooling module comprising a plurality of means spraying a cooling medium onto the rail, during the active cooling phase, each cooling module being provided with plurality of cooling sections, each section being located in a plan transversal to the rail when the rail is within the thermal treatment system, and each section comprising at least:

one cooling means located above the head of the rail, two cooling means located on each side of the head of the rail, and one cooling means located under the feet of the rail and characterised in that, each cooling means is driven to control the cooling rate of the rail such that the amount of transformed austenite within the rail is not lower than 50% on rail surface and not lower than 20% at rail head core.

According to other features of the invention taken alone or in combination:

each cooling means are driven to control the cooling rate of the rail such that the austenite is transformed into high performance bainite or into fine pearlite.

before the thermal treatment of the rail:

providing models with a plurality of parameters relative to the rail to treat;

providing said models with values defining the desired final mechanical properties of the rail;

computing control parameters to drive the cooling means to obtain cooling rates such that predefined temperatures of the rail after each cooling modules are obtained;

applying said computed parameters to drive the cooling means of the cooling modules.

the method can further comprises:

measuring surface temperatures of the rail upstream of each cooling module and comparing these temperatures with the ones calculated by the models;

modifying the driving parameter of the cooling means if the differences between the calculated temperatures and the measured ones are greater than predefined values.

the cooling medium is a mixture of air and water atomised by the cooling means around the sections of the rail, the quantity of air and the quantity of water atomised being independently controlled.

the skin temperature of the rail entering the first cooling module is comprised between 750 and 1000° C. and the skin temperature of the rail exiting the last cooling module is comprised between 300° C. to 650° C.

the rail is cooled by the cooling means at a rate comprised between 0.5 and 70° C./s.

According to a second aspect, the invention concerns a system for thermal treatment of a hot rail to obtain a desired microstructure having enhanced mechanical properties, the system comprising:

an active cooling system comprising a plurality of cooling modules; each cooling module comprising a plurality of cooling means operable for spraying a cooling medium onto the rail;

controlling means for controlling the spraying of the cooling means, characterised in that each cooling module comprises a plurality of cooling sections, each cooling section being located in a plan transversal to the rail when the rail is within the thermal treatment system, each section comprising at least:

one cooling means (N1) located above the head of the rail, two (N2, N3) cooling means located on each side of the head of the rail, and one cooling means located under the feet of the rail (6), and in that the controlling means are operable to drive the cooling means such that the amount of transformed austenite within the rail is not lower than 50% on rail surface and not lower than 20% at rail head core, the transformation occurring while the rail is still within the active cooling system.

According to other features of the invention taken alone or in combination:

the control means drive the cooling means such that high performance bainite or into fine pearlite, the system may further comprises temperature measuring means located upstream each cooling module and connected to the controlling means.

each temperature measuring means comprises a plurality of heat sensors located around a section of the rails to continuously sense the temperature of different parts of the rail section, the control means comprise models receiving parameters relative to the rail entering the cooling system and the values defining the desired final mechanical properties of the rail, the models providing the driving parameters of the cooling means to obtain the desired mechanical properties.

each cooling module comprises a plurality of cooling section, each section being located in a plan transversal to the rail when the rail is within the thermal treatment system, and each set comprising at least six cooling means, one located above the head of the rail, two located on each side of the head, two located on both sides of the web of the rail, one (N6) located under the feet of the rail, the cooling means are atomizer nozzles able to spray a mixture of water and air, the quantity of air and the quantity of water atomised being independently controlled.

BRIEF DESCRIPTION OF THE SEVERAL VIEWS OF THE DRAWING

Other objects and advantages of the present invention will be apparent upon consideration of the following specification, with reference to the accompanying drawings wherein:

FIG. 11 shows the values of hardness at the different measurement points for a fine pearlitic rail obtained with a method according to the invention.

DESCRIPTION OF THE INVENTION

Figure 1:
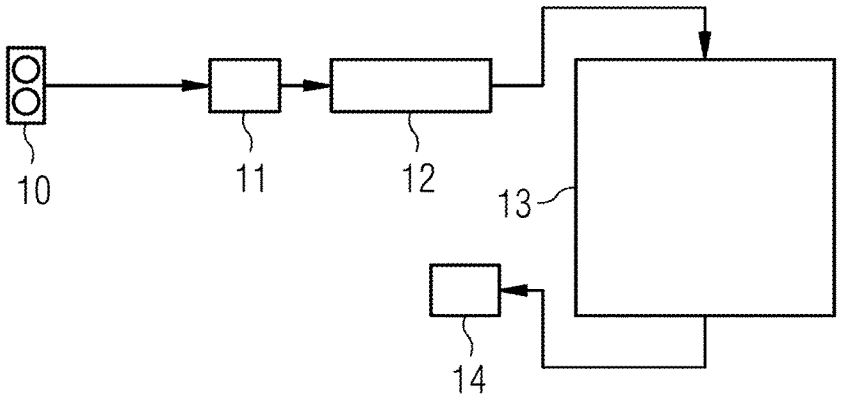
FIG. 1 is schematic view of a system according to the invention.

FIG. 1 is a schematic view of the layout of the cooling part of a rolling mill according to the invention. After having been shaped by the last rolling stand 10, the rail is introduced subsequently into: a reheating unit 11 to equalize the rail temperature, a thermal treatment system 12 according the invention, an open air cooling table 13 and a straightening machine 14.

Alternatively, in a off-line embodiment (not shown on the drawings), instead of coming directly from the last rolling stand, the product, in an rolled condition, entering the reheating unit can be a cold rail coming from a rail yard (or from a storage area).

Figure 2:
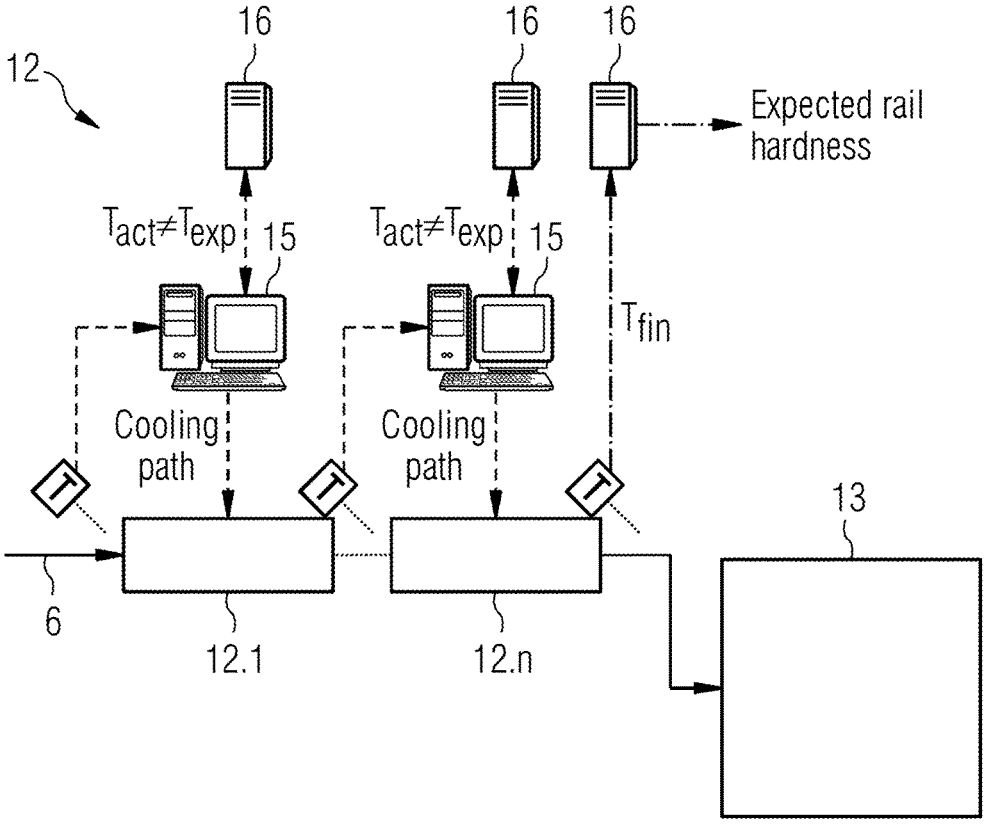
FIG. 2 is a detailed view of the components of a thermal treatment system according to the invention.

FIG. 2 is a schematic detailed view of a cooling system according to the invention. The cooling system comprises a plurality of cooling modules 12.1, 12.2 . . . **12.*n* wherein the rail 6 is cooled after hot rolling or after re-heating. The rail is cooled by passing through the cooling module thanks to a conveyor which carries the rail at a predetermined velocity. Upstream of each cooling module 12.1 to 12.*n* temperature measuring devices T are located to sense the temperature of the rail. This information is provided to control means 15 (for example computer means) communicatively connected with data bases 16** containing process models and libraries.

Figure 3:
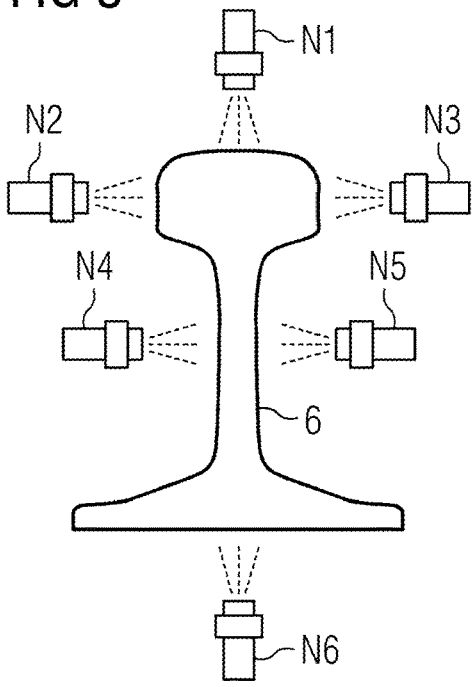
FIG. 3 is a transversal cross section of a rail surrounded by a plurality of cooling means.

Each cooling module **12.*n* comprises a plurality of aligned cooling section. Each cooling section comprises nozzles located in the same plan define by a transversal cross section of the rail. FIG. 3 is a transversal cross section of a rail 6 where a possible nozzles configuration pertaining to the same cooling section can be seen. In this embodiment, the cooling section comprises six nozzles located around the cross section of the rail 6. One nozzle N1 is located above the head of the rail, two nozzles N2 and N3 are located on each side of the head, two optional nozzles N4 and N5 are located on both sides of the web of the rail and one last nozzle N6 is located under the feet of the rail 6**.

Each nozzle N1-N6 can spray different cooling medium (typically water, air and a mixture of water and air). The nozzles N1-N6 are operated by the control means 15 individually or in group, depending on the targeted final mechanical characteristics of rail.

The exit pressure of each nozzle N1-N6 can be chosen and controlled independently by the means 15.

Due to its geometry the corner of the rail head is a part naturally subjected to a higher cooling relative to the other head areas; acting directly with a cooling mean on the corners of the head could be dangerous and could overcool the head corners which in turn brings to the formation of bad microstructure like martensite or low quality bainite. This why nozzles N2 and N3 are located on the sides of the head, and are arrange to spray the cooling medium on the sides of the head of the rail, and to avoid spraying on the top corners of the rail. In one embodiment nozzles N2 and N3 are located transversal (perpendicular) to the travelling direction of the rail.

The control of the parameters of each nozzle by the control means 15 enables:

- obtaining the targeted microstructure (i.e. high performance bainite or fine pearlite);
- limiting the distortion across the profile and along the full length.

Figure 4:
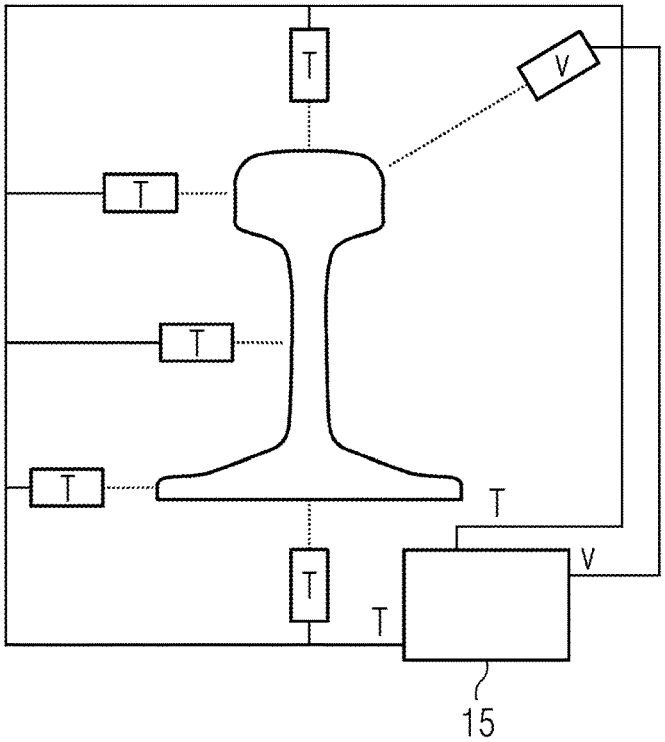
FIG. 4 is a transversal cross section of a rail surrounded by a plurality of temperature measuring devices.

FIG. 4 is a schematic view of the location of the temperature measuring devices T. As can be seen on this figure, a plurality of temperature measuring devices T are located around a transversal cross section of the rail 6 upstream each cooling module in the advancing (or forward) direction of the rail. In this embodiment, five temperature measuring devices T are used. One located above the rail head, one located on the side of the rail head, one located on the side of the rail web, one on the side of the rail feet and a last one is located under the rail feet. The temperature measuring devices can be a pyrometer or a thermographic camera or any other sensor capable of providing the temperature of the rail. If vapour is present between the thermographic camera and the material surface, the temperature measurement is permitted by a localized and impulsive air jet.

All information concerning the temperature are provided to the control means 15 as data to control the rail cooling process.

The control means 15 control the rail thermal treatment by controlling the parameters (flow rates, temperature of the cooling medium, and pressure of the cooling medium) of each nozzle of each cooling module and also the entry rail velocity. In other words, the flow, pressure, number of active nozzles, position of the nozzles and cooling efficiency of every nozzle group (N1, N2-N3, N4-N5 and N6) can be individually set. Any module **12.*n*** can therefore be controlled and managed alone or coupled with one or more modules. The cooling strategy (e.g. heating rate, cooling rate, temperature profile) is pre-defined as a function of the final product properties.

The flexible thermal treatment system, comprising the above mentioned control means 15, the cooling modules **12.*n* and the measuring means T and S, is able to treat rails with an entry temperature in the range of 750-1000° C. measured on the running surface of the rail 6**. The entry rail speed is in range of 0.5-1.5 m/s. The cooling rate reachable is in the range of 0.5-70° C./s as function of desired microstructure and final mechanical characteristics. The cooling rate can be set at different values along the flexible thermal treatment apparatus. The rail temperature at the thermal treatment system exit is in the range of 300-650° C. The rail hardness in the case of high performance bainite microstructure is in the range of 400550 HB, in the case of fine pearlite microstructure is in the range of 320-440 HB.

Figure 5:
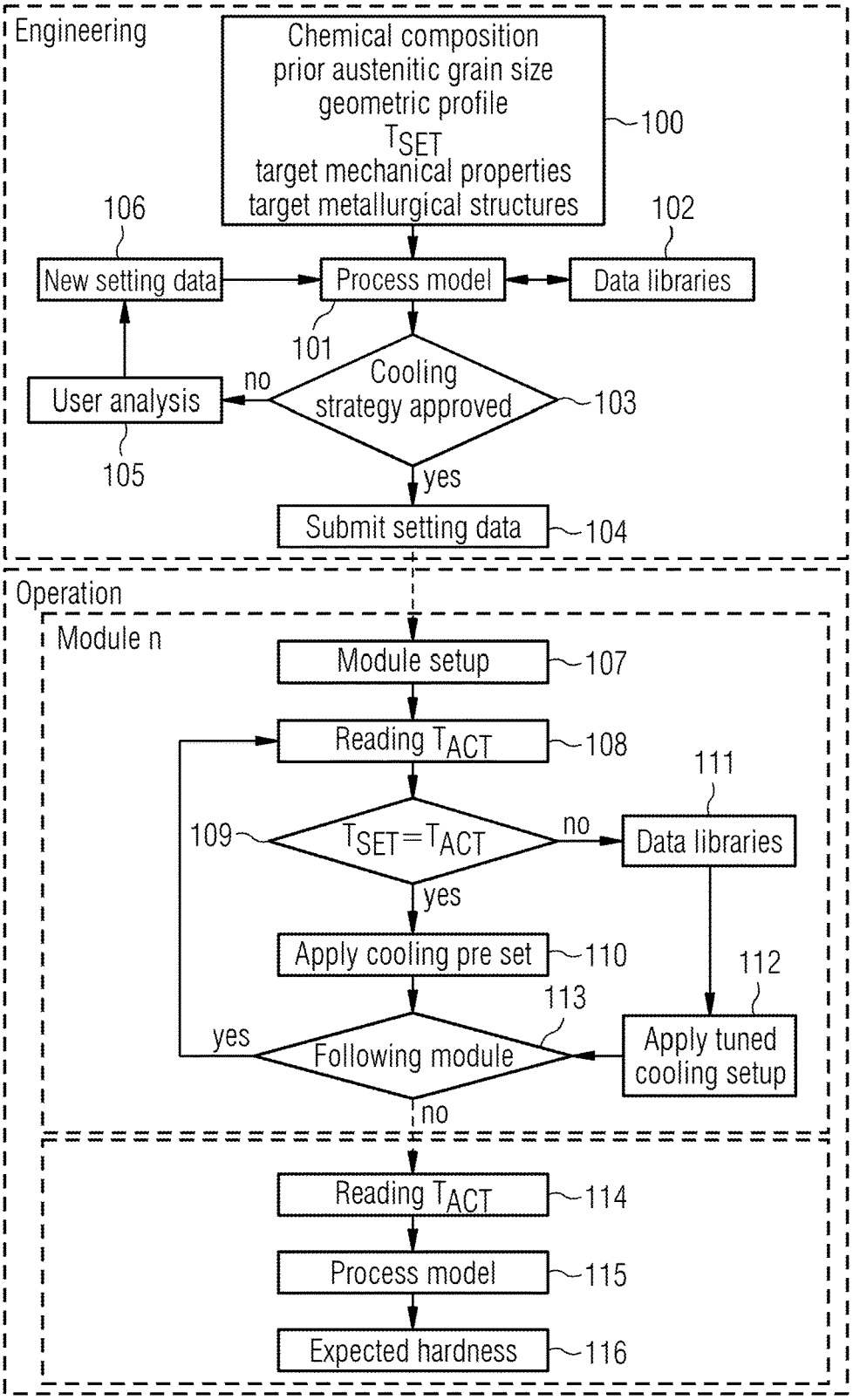
FIG. 5 is a schematic view of the steps of the method according to the invention.

FIG. 5 shows the different steps needed to control each cooling module according to the present invention.

During step 100 a plurality of setting values are introduced in the cooling control means 15. In particular:

- chemical composition of the steel used for the rail production;
- hot rolling mill setup and procedures;

rail austenite grain size entering the cooling system;
expected austenite decomposition rate and austenite transformation temperature;
geometry of the rail section;
expected rail temperature in defined profile points (head, web and foot) and along the length;
the targeted mechanical properties, for example: hardness, strength, elongation and toughness.

At step 101, the setting values are provided in different embedded models (hosted by the computerised control means 15) that work together in order to provide the best cooling strategy. Several embedded numerical, mechanical and metallurgical models are used:

Austenite decomposition with microstructure prediction.
Precipitation models.
Thermal evolution including transformation heat.
Mechanical properties.

The embedded process models define the cooling strategies in terms of heat to be removed from the profile and along the length of the rail taking into account entry rail velocity. A specific cooling strategy in function of time is proposed such that the amount of austenite transformed is not lower than 50% on rail surface and not lower than 20% at rail head core at the exit of the flexible thermal treatment system. This means that the above mentioned transformation occurs while the rail is still inside the thermal treatment system and not outside, after or downstream this system. In other words, for a transversal cross section of a rail advancing within the thermal treatment system 12, the above mentioned transformation occurs between the first and the last cooling sector of the system. This means that this transformation is fully controlled by the thermal treatment system 12. An example of cooling strategy computed by the embedded process models is given by the curves of FIGS. 8 and 9.

At step 102 the control system 15 communicates with the data libraries 16 in order to choose the correct thermal treatment strategy, after the evaluation of the input parameters.

The pre-set thermal treatment strategy is then fine-tuned taking into account the actual temperature, measured or predicted during the rail process route. This guarantees the obtainment of expected level of mechanical characteristics all along the rail length and through transverse rail section. Very strict characteristic variation can be obtained avoiding formation of zone with too high or too low hardness and avoiding any undesired microstructure (e.g. martensite).

At step 103, the control means 15 show the computed thermal treatment strategy and the expected mechanical properties to the user, for example on a screen of the control means 15. If the user validates the computed values and accept the cooling strategy (step 103), settings data are submitted to the cooling system at step 104.

If the user does not validate the cooling strategy new setting data are provided by the user (step 105 and 106) and step 101 is executed.

Further at step 107 a first cooling modules set up is carried out. The suitable parameters (e.g. pressure, flow rate) are provided to each module according to the optimized cooling strategy suggested by the process models at step 101. At this step, the cooling flux (or rate) is imposed to the different nozzles of the different modules of the cooling system 12 in order to guarantee the obtainment of the target temperature distribution in due time.

At step 108 measures of surface temperatures of the rail 6 coming from the hot rolling mill 10 or from a rail yard (or storage area) are taken before the rail enter each cooling module 12.*n*, for example upstream of cooling module 12.1. The temperature measuring devices T take temperature measures continuously. This set of data is used by the thermal treatment system 12 to impose the fine regulation to the automation system in terms of cooling flux in order to take into account the actual thermal inhomogeneity along the rail length and across the rail section.

At step 109 the measured temperatures are compared with the ones calculated by the process models at step 101 (temperature that the rail should have at the location of the current temperature measuring device). If the differences between the temperatures are not bigger than predefined values, the cooling pre-set parameters are applied to drive the cooling modules.

In case of differences, between the calculated temperature and the measured temperatures, at step 111 the pre-set value of heat flux removal for the current module of the cooling module 12.*n* is consequently modified with values taken from the data libraries 16, and at step 112 the new values of heat flux removal (or cooling rate) are applied to control the cooling modules.

At step 113, if there is other modules step 108 is repeated and a new set of temperature profile of the rail surface is measured in step 108.

At step 114, at the exit of the last cooling module 12.*n* of the flexible cooling system 12 a final temperature profile is taken. The cooling control means 15 calculate the remaining time for cooling down the rail till ambient temperature on the cooling bed. This is important to estimate the progression of the cooling process across the rail section.

At step 115, the real cooling strategy previously applied by the cooling system is provided to the embedded process models in order to obtain the mechanical properties expected for the final product, and at step 116 the expected mechanical properties of the rail are delivered to the user.

Figure 6:
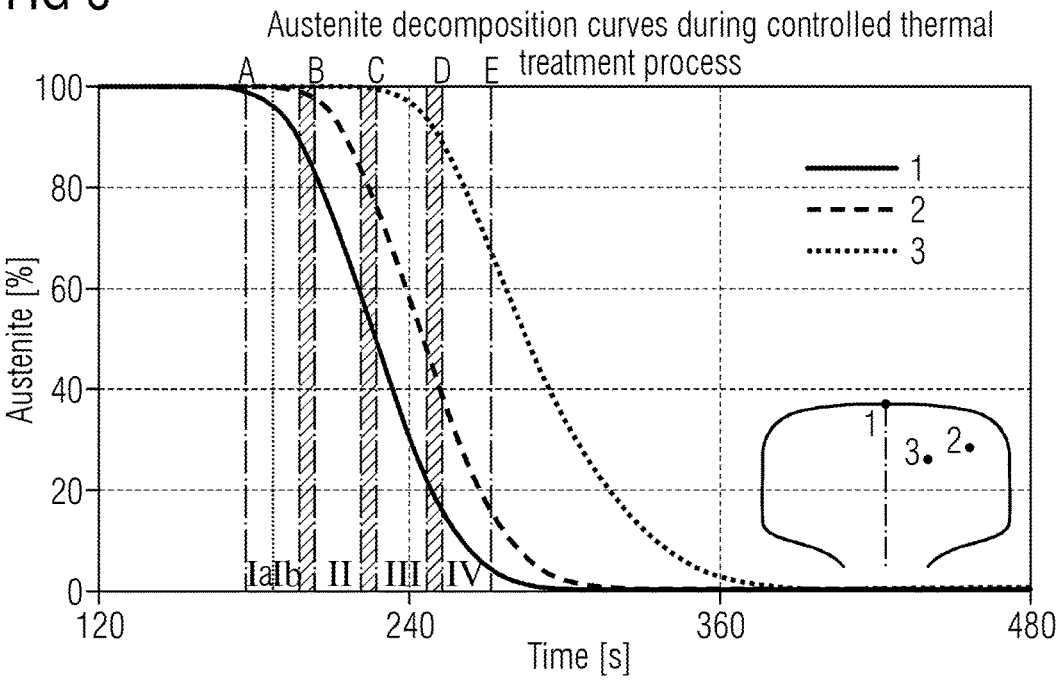
FIG. 6 shows an example of austenite decomposition curves during a thermal treatment process controlled according to the invention.
Figure 7:
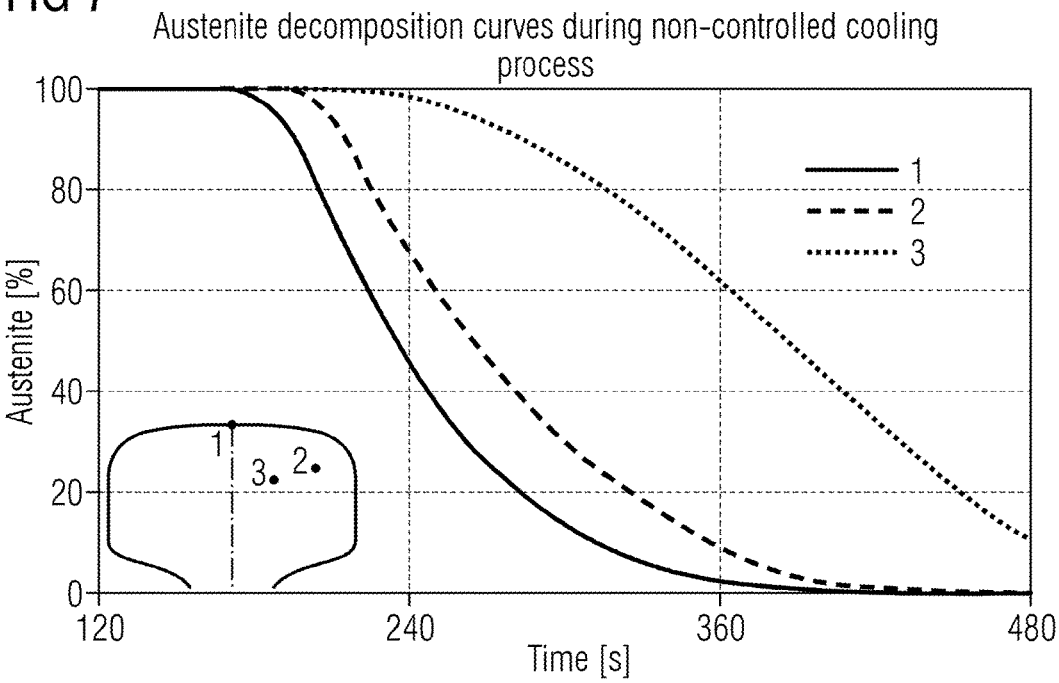
FIG. 7 shows typical austenite decomposition curves during a non-controlled thermal treatment process.

FIGS. 6 and 7 show the austenite decomposition respectively in a rail thermally treated with the method according to the invention and without the invention. These figures show this austenite decomposition for different points (1, 2 and 3) contained in a transversal cross section of the rail.

In FIG. 6 the vertical doted lines A, B, C and D correspond to the transversal cross section of a rail containing points 1, 2 and 3 in each cooling module 12.*n* and line E materialises the exit of these points from the thermal treatment system 12.

As can be seen, on FIG. 6, the amount of transformed austenite within the rail is more that 80% on rail surface and around 40% at rail head core.

From the austenite decomposition curve of a controlled thermal treatment, shown in FIG. 6, it is clear that the austenite is transformed into the final microstructure faster and more homogeneously across the rail head, than in a non-controlled treatment (FIG. 7). This is very important to obtain excellent mechanical properties in terms of hardness, toughness and elongation, homogeneously distributed in the final product.

Figure 8:
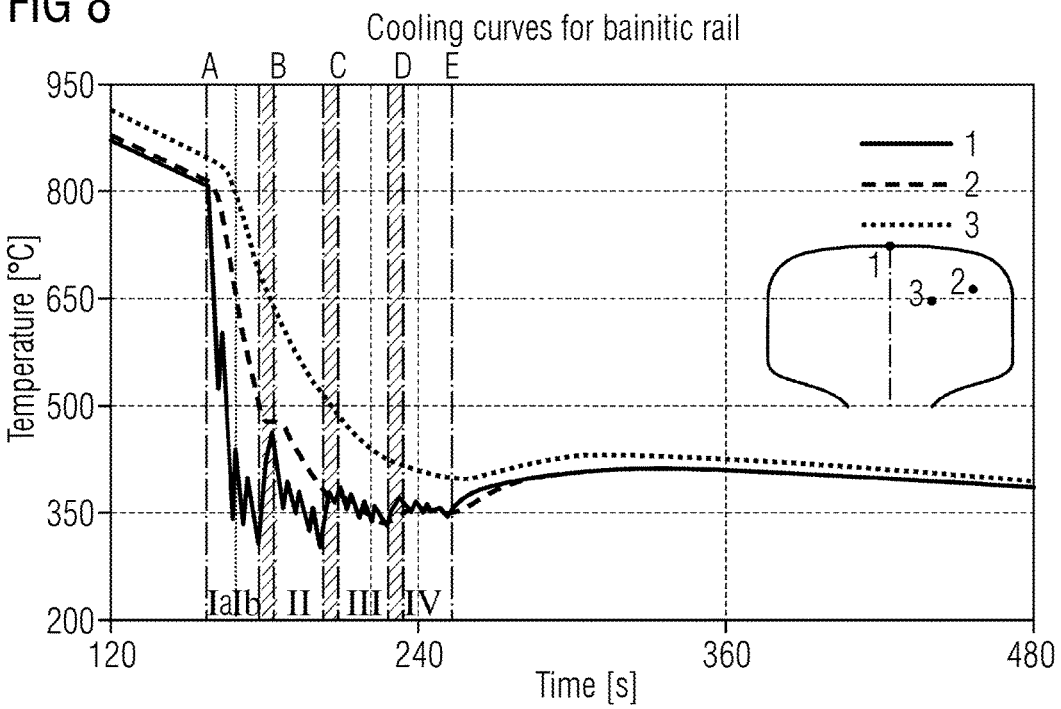
FIG. 8 shows the evolution of temperature across the rail section during controlled cooling process, in accordance with the method to obtain high performance bainitic microstructures.
Figure 9:
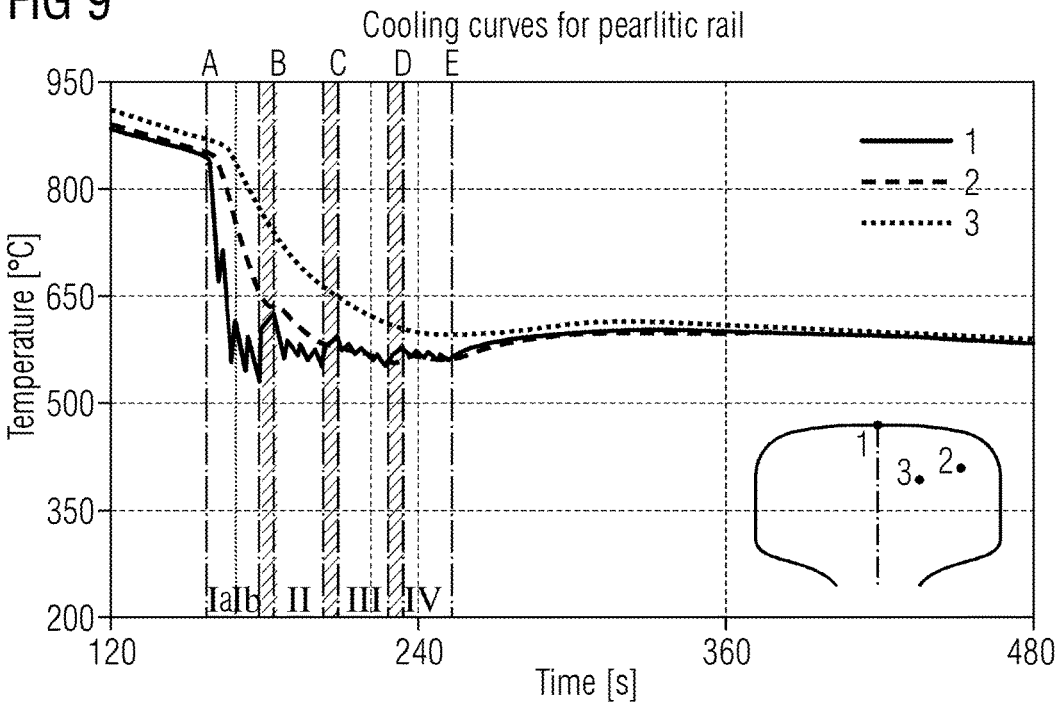
FIG. 9 shows the evolution of temperature across the rail section during controlled cooling process, in accordance with the method to obtain fine pearlitic microstructures.

Two examples of targeted temperature evolutions in three different points, in the section of a rail, cooled according to the invention are shown in FIGS. 8 and 9 respectively for high performance bainite and fine pearlite rails.

FIG. 8 gives the evolution of temperature provided by the models to obtain a bainitic rail. The vertical dotted lines A, B, C and D correspond to the entry, of the transversal cross section of the rail containing points 1, 2 and 3, in each cooling module 12.*n* and line E materialises the exit of these points from the thermal treatment system 12.

The system parameters (water and/or air flow rate) are controlled in order that the temperatures of different points of the rail match the temperatures provided by these curves. In other words these curves give the target evolution of temperature values of predefined set points across the rail section.

Following the temperature provided from the models, the rail is controlled to enter the first module with a temperature of about 800° C. Subsequently, in a phase $I_a$ the rail skin (curve 1) is fast cooled by the first two cooling modules down to a temperature of 350° C. with a cooling rate in this example of approximately 45° C./s. Here, fast cooling means a cooling with a cooling rate comprised between 25 and 70° C./s.

After this fast cooling phase, the rail is soft cooled by the remaining cooling nozzles of the first cooling modules, and by the remaining cooling modules. For example in a phase $I_b$, the rail is cooled with a cooling rate of approximately 13° C./s. Between the end of the phase $I_b$ (exit of the first cooling module) and the entry in the second cooling module materialised by the vertical dotted line B, the rail skin is naturally heated by the core of the rail and the rail skin temperature increases. Thereafter, the rail enters the second cooling module (phase II) and the rail is cooled with a cooling rate of approximately 8.7° C./s. Subsequently the rail enters the third and fourth cooling modules (in phases III and IV) and is cooled with approximate cooling rates of respectively 2.7 and 1.3° C./s. Of course between the exit of each cooling module 12.*n* and the entry of the next cooling module, natural increase of the skin temperature of the rail occurs due to the rail core temperature. Here, soft cooled means a cooling rate comprises between 0.5 and 25° C./s.

In case of entering temperature higher of 800° C. the modules acting in area Ib will be controlled such that to also produce fast cooling.

Figure 10:
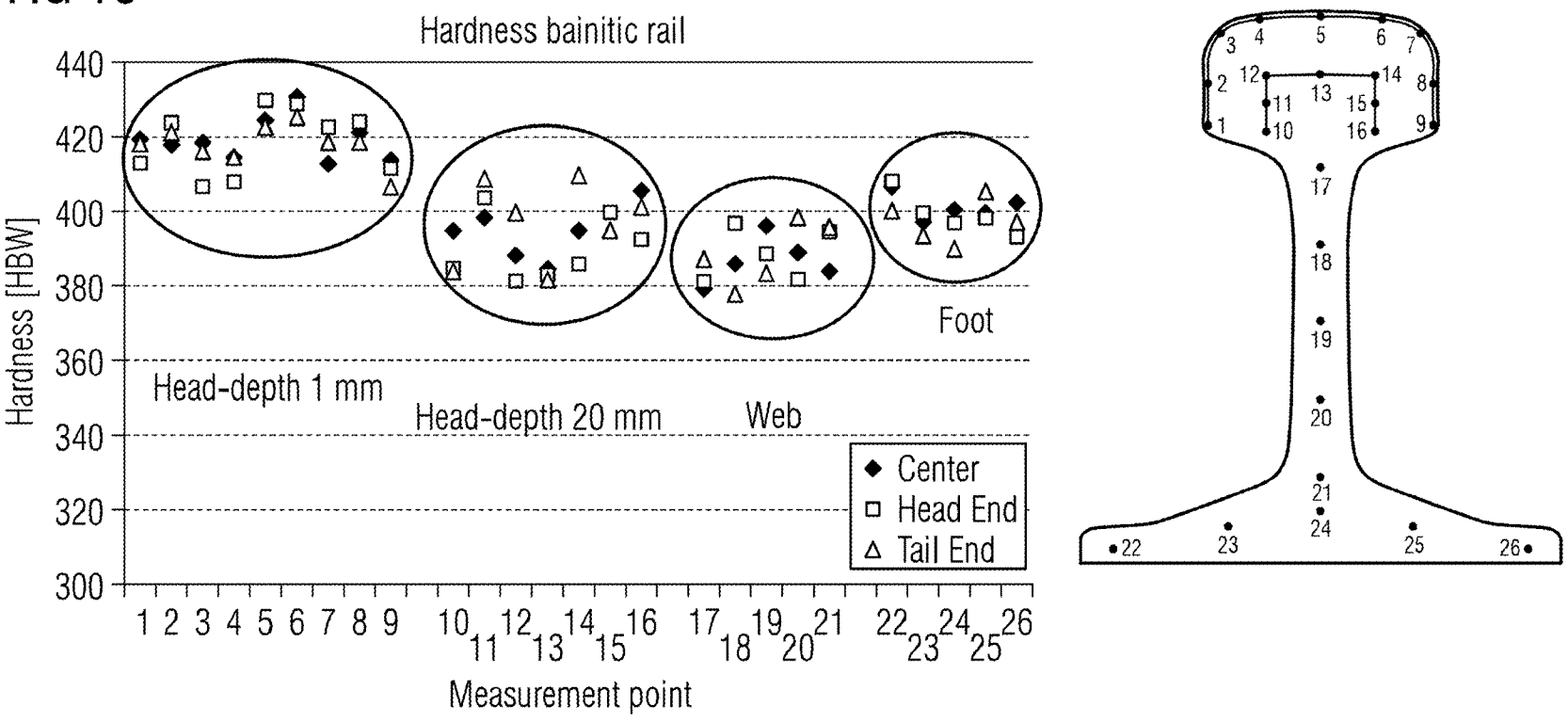
FIG. 10 shows the values of hardness at the different measurement points for a high performance bainitic rail obtained with a method according to the invention.

The final microstructure is fully bainite with hardness on the rail head in the range of 384-430 HB as shown in FIG. 10.

FIG. 9 gives the evolution of temperature provided by the models to obtain a pearlitic rail. The vertical dotted lines A, B, C and D correspond to the entry, of the transversal cross section of the rail containing points 1, 2 and 3, in each cooling module 12.*n* and line E materialises the exit of these points from the thermal treatment system 12.

Following the temperature provided from the models, the rail is controlled to enter the first module with a temperature in a range of about 850° C. Subsequently, in a phase $I_a$ the rail skin is fast cooled by the first cooling module down to a temperature of about 560° C. with a cooling rate in this example of approximately 27° C./s. Here, fast cooling means a cooling with a cooling comprised between 25° C./s to 45° C./s.

After this fast cooling phase, the rail is soft cooled by the remaining cooling nozzles of the first cooling modules, and by the remaining cooling modules. For example in a phase $I_b$, the rail is cooled with a cooling rate of approximately 8° C./s. Between the end of the phase $I_b$ (exit of the first cooling module) and the entry in the second cooling module materialised by the vertical dotted line B, the rail skin is naturally heated by the core of the rail and the rail skin temperature increases. Thereafter, the rail enters the second cooling module (phase II) and the rail is cooled with a cooling rate of approximately 4° C./s. Subsequently the rail enters the third and fourth cooling module (in phases III and IV) and is cooled with approximate cooling rates of respectively 1.8 and 0.9° C./s. Of course between the exit of each cooling module 12.*n* and the entry of the next cooling module natural increase of the skin temperature of the rail occurs due to the rail core temperature.

Here, soft cooled means a cooling rate comprised between 0.5 and 25° C./s.

In case of entering temperature of higher than 850° C. the modules acting in area Ib will be controlled such that to also produce fast cooling.

After the above mentioned process, the final microstructure is fine pearlite with hardness on the rail head in the range of 342-388 HB as shown in FIG. 11.

The above mentioned curves are the cooling strategy adopted according to the invention. In other words, each nozzle is controlled such that the temperature distribution across the rail section follows the curves of FIGS. 8 and 9.

The present invention overcomes the problems of the prior art by means of fully controlling the thermal treatment of the hot rail until a significant amount of austenite is transformed. This means that the austenite transformation temperature is the lowest possible to avoid any kind of secondary structures: martensite for high quality bainitic rails and martensite or upper bainite for pearlitic rails.

As above shown, the process according to the invention is designed for obtaining fully high performance bainite microstructure characterised by high strength, high hardness and good toughness in the whole rail section and, also, for obtaining fully pearlite fine microstructure in a selected portion of the rail section or in the whole rail section.

The process is characterised by a significant amount of austenite transformed to the chosen bainite or pearlite microstructures when the rail is still subjected to the cooling process. This guarantees the obtainment of a high performance bainite or fine pearlite microstructures. In order to correctly impose the requested controlled cooling pattern to the rail along all the thermal treatment, the flexible cooling system includes several adjustable multi means nozzles typically, but not limited to, water, air and a mixture of water and air. The nozzles are adjustable in terms of on/off condition, pressure, flow rate and type of cooling medium according to the chemical composition of the rail and the final mechanical properties requested by the rail users.

Process models, temperature monitoring, automation systems are active parts of this controlled thermal treatment process and allow a strict and process control in order to guarantee high quality rails, a higher level of reliability and a very low rail rejection.

The rails so obtained are particularly indicated for heavy axle loads, mixed commercial-passenger railways, both on straight and curved stretches, on traditional or innovative ballasts, railway bridges, in tunnels or seaside employment.

The invention also allows obtaining a core temperature of the rail close to the skin temperature and this homogenises the microstructure and the mechanical features of the rails.

The invention claimed is:

1. A method of thermally treating heated rails to obtain a desired microstructure having enhanced mechanical properties, which comprises the steps of:

performing an active cooling phase with a plurality of cooling modules during which a rail is fast cooled at a higher cooling rate by at least one of the plurality of cooling modules from an austenite temperature and subsequently soft cooled at a lower cooling rate by at least another one of the plurality of cooling modules to maintain a target transformation temperature between defined values, each of the plurality of cooling modules having a plurality of cooling devices spraying a cooling medium onto the rail, wherein the higher cooling rate performed by the one of the plurality of cooling modules is between 25 and 70° C./s and the lower cooling rate performed by the other one of the plurality of cooling modules is between 0.5 and 25° C./s;

during the subsequent soft cooling of the active cooling phase, individually controlling the plurality of cooling modules under four phases with different cooling rates along the plurality of cooling modules;

providing each of the cooling modules with a plurality of cooling sections, each of the cooling sections disposed in a plane transversal to the rail when the rail is within a thermal treatment system, each of the cooling sections containing:

one of the cooling devices disposed above a head of the rail;

two of the cooling devices disposed on each side of the head of the rail; and one of the cooling devices disposed under feet of the rail;

during the active cooling phase, driving each of the cooling devices to control a cooling rate of the rail such that an amount of transformed austenite within the rail is not lower than 50% on a rail surface and not lower than 20% at a rail head core; and during the active cooling phase, driving at least some of the cooling devices to control a cooling rate of the rail based on a measured temperature of the rail.

2. The method according to claim 1, which further comprises driving each of the cooling devices to control the higher cooling rate and the lower cooling rate such that the austenite is transformed into bainite having a hardness from 550 to 400 HB.

3. The method according to claim 1, which comprises performing the further steps of:

providing models with a plurality of parameters relative to the rail to treat;

providing the models with values defining desired final mechanical properties of the rail;

computing control parameters to drive the cooling devices to obtain cooling rates such that predefined temperatures of the rail after each of the cooling modules are obtained; and applying computed parameters to drive the cooling device of the cooling modules.

4. The method according to claim 3, which further comprises:

measuring surface temperatures of the rail upstream of each of the cooling modules and comparing the surface temperatures with ones calculated by the models; and modifying a driving parameter of the cooling devices if differences between calculated temperatures and measured ones are greater than predefined values.

5. The method according to claim 1, which further comprises forming a cooling medium from a mixture of air and water atomized by the cooling devices around sections of the rail, a quantity of the air and a quantity of the water atomized being independently controlled.

6. The method according to claim 1, wherein a skin temperature of the rail entering a first cooling module is contained between 750° C. and 1,000° C. and the skin temperature of the rail exiting a last cooling module is contained between 300° C. to 650° C.

7. The method according to claim 1, which further comprises driving each of the cooling devices to control the higher cooling rate and the lower cooling rate such that the austenite is transformed into pearlite having a hardness from 440 to 320 HB.

8. The method according to claim 1, wherein the higher cooling rate performed by the one of the plurality of cooling modules is at least twice as high as the lower cooling rate performed by the other one of the plurality of cooling modules.

* * * * *